United States Patent [19]

Banasky

[11] Patent Number: 5,037,108

[45] Date of Patent: Aug. 6, 1991

[54] METHOD OF PLAYING CARDS GAME

[76] Inventor: Charles Banasky, 1549 Palos Verdes Dr. West, Palos Verdes Estates, Calif. 90274

[21] Appl. No.: 567,807

[22] Filed: Aug. 15, 1990

[51] Int. Cl.[5] ..... A63F 3/00; A63F 1/00

[52] U.S. Cl. ..... 273/242; 273/303

[58] Field of Search ..... 273/236, 242, 243, 292, 273/303–306

[56] References Cited

U.S. PATENT DOCUMENTS

| | | | |
|---|---|---|---|
| 1,310,177 | 7/1919 | Coleman | 273/292 |
| 1,632,941 | 6/1927 | Abell | 273/303 |
| 2,602,667 | 7/1952 | Poarch | 273/243 |

*Primary Examiner*—Benjamin Layno

*Attorney, Agent, or Firm*—Lyon & Lyon

[57] ABSTRACT

A game which may be, but does not have to be, played on a diamond shaped board with contiguous sections in a continuous band around its periphery, a playing piece, and playing cards. Sections on the board affect the strategy of when to take or pass playing cards. Individual play involves drawing a card to determine the section of the board that the playing piece will land on. Once on a section, the player must draw cards and take or pass them according to the section on the board. Players attempt to build-up and retire stacks of cards to score points. The player with the highest score wins.

6 Claims, 6 Drawing Sheets

METHOD OF PLAYING CARDS GAME

FIELD OF THE INVENTION

The present invention relates to card games and more specifically to a game with cards which are kept or passed to another player and are used to score points.

BACKGROUND OF THE INVENTION

Card games have been a popular form of entertainment for centuries. In light of their popularity, Queen Elizabeth I granted a patent for the manufacture and sale of playing cards to Ralph Bowes and Thomas Bedingfield in 1576 (Fox, Harold G., *Monopolies and Patents.* University of Toronto Press (1947), p. 88). Undoubtedly, the popularity of card games stems from the infinite number of novel methods of play that are possible. The present invention is a card game where passing cards and adding them up to a specific number is part of the strategy. Here, a special deck of cards determines how far a player moves along the game board. Sections on the board affect the strategy of when a player passes cards drawn from the deck.

In 1943 Von Neumann and Morgenstern published their classic book, *Theory of Games and Economic Behavior*, in which they related aspects of game theory to social interactions such as business dealings and politics. Similarly, McDonald has compared game theories and poker strategies to business coalitions and atomic warfare (J. McDonald; *Strategy in Poker, Business and War*, Vail-Ballou Press, Inc. (1950) 128 pages). They submit that imperfect information creates uncertainty among individuals in games and in society at large. The present invention attempts to maximize all players' access to information by requiring that all cards be turned face up and by encouraging lively strategic discussions between players. Therefore, there are no deceptive strategies in this game.

Because all of the cards are visible to all players, the game encourages partnerships between players of disparate ages and skills. With strategic discussions, the more experienced player can direct the other's play. This feature lends the game for use as a learning tool that, for example, a father could use with his young daughter. By playing the game, the child could learn basic counting as well as experience an introduction to adult interactions.

The game is also meant to incorporate several types of game theories all in one game. For example, a four person game begins with two sets of partners discussing strategy. In the beginning, these players will use partnership aspects of game theory. As players drop out of the game, the strategy and type of game changes. When the game becomes a three player game, the two remaining partners can gang up to eliminate the third player. The game then becomes a two person rivalry game. When another player is eliminated the remaining player finishes the game by playing solitaire. Thus, the game is an unusual combination of several types of games all in one. A goal of this game is to expand players innate understanding of the social interactions associated with business transactions and politics.

SUMMARY OF THE INVENTION

The present invention may comprise a board, a game piece, and a deck of cards. In the preferred embodiment, the deck of cards contains sixty cards with four different suits of fifteen cards each. In addition, squares on the board are marked in four different categories, each affecting the strategy of whether to take or pass the card. An advantage of the invention is an entertaining method of playing cards that requires communication between the players.

Unlike other games, this game incorporates many aspects of game theory: from partnership play to solitaire, and from ganging up on an individual competitor to one-on-one rivalry. Also unlike many other card games, all of the played cards are visible to all players. Therefore, there is no bluffing. This feature is designed to enhance the communication and social interactions between players.

An object of the game is to build up stacks of cards to a specified number and then retire the stack by placing a special card on the stack. More points are scored when the stack contains more cards and also when the numbered cards are all one suit. In the preferred embodiment, the specified number is 9 and each suit is a different color: red, blue, yellow, and green. Furthermore, the red, blue, and yellow suits are numbered 1–5. Each numbered suit is comprised of two number 1 cards, three number 2 cards, five number 3 cards, three number 4 cards, and two number 5 cards. See FIG. 7.

Adding the stacks to 9 is nonobvious as is the numbers of cards of each denomination. If a number greater than 9 is used as the goal of the stack, then the game moves too slowly. If a number less than 9 is used, then the game moves too quickly. To make the game move at the proper speed for the purposes of frequency of scoring and the level of difficulty, it is important to have the denominations of cards be 1–5. It was also discovered that too many number 1 cards made the game move too slowly, and too many number 5 cards made the game move too quickly. The inventor toiled to come up with the proper number of cards in each denomination as illustrated in FIG. 7.

The fourth suit is the green "slam" suit, which may be used to retire stacks. There are numerous variations and additions to this preferred embodiment. For example, the size of the deck or the number of suits could be either smaller or larger. Also the distinguishing characteristic of each suit could be changed. It is also foreseeable that the game could be played by adding the stacks up to different specified numbers. It is even possible to change the strategy required by the sections on the game board. It is a minor adjustment to play the game with more than five players, to play it with more than one "slam" deck, or to play it without the game board.

DESCRIPTION OF THE FIGURES

In order that the principle of the invention may be readily understood, a single preferred embodiment of the game is disclosed in the accompanying drawings.

FIG. 7 is a schematic illustrating the pyramid nature of the number of cards of a specific denomination.

DETAILED DESCRIPTION OF THE PREFERRED EMBODIMENT

Figure 1:
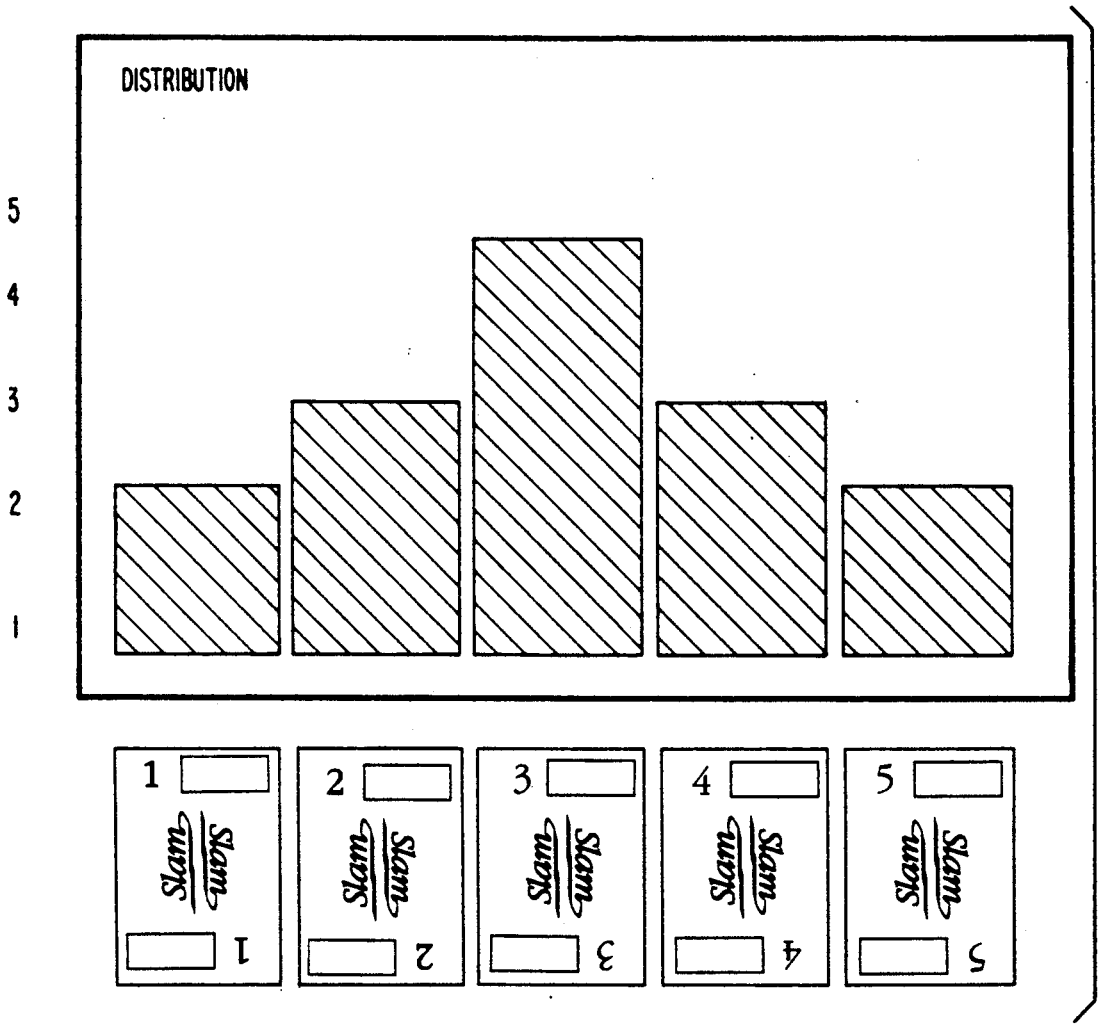
FIG. 1 is a top view of the game board used in the game embodying the present invention.
Figure 2:
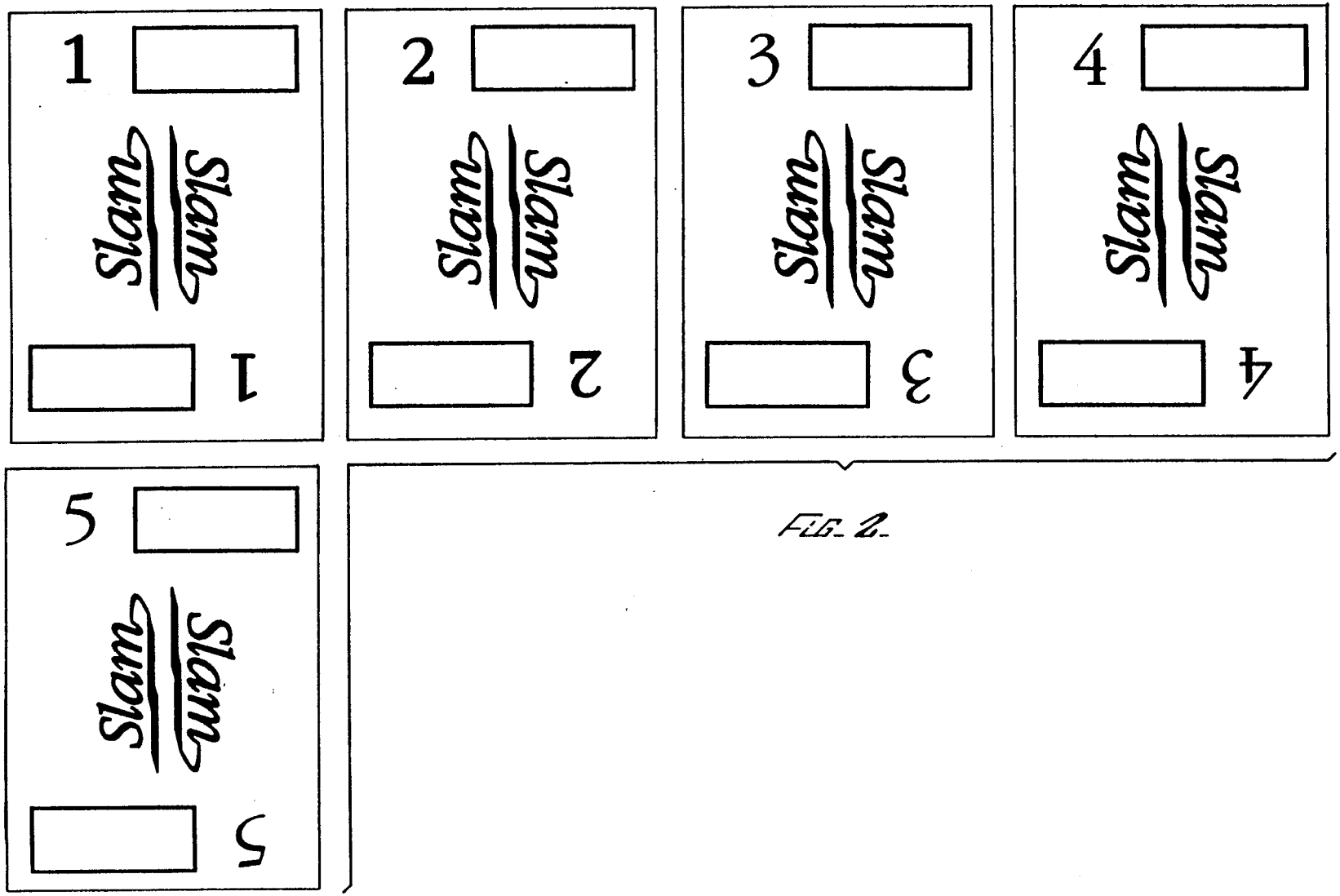
FIG. 2 is a top view of a numbered suit of cards.
Figure 3:
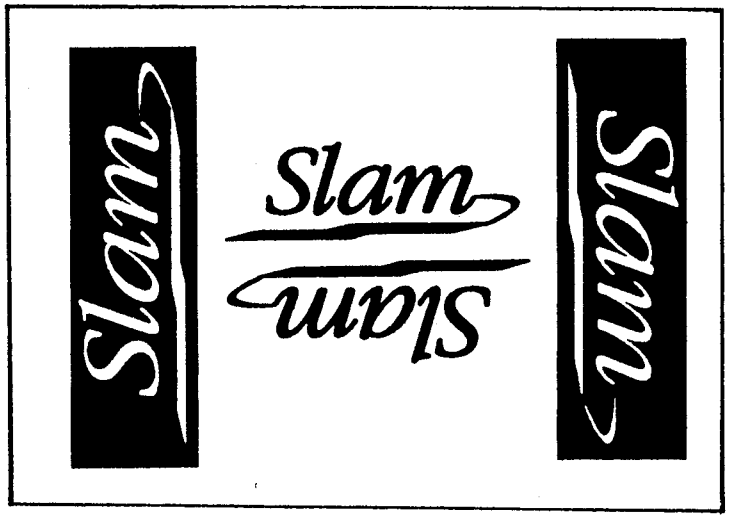
FIG. 3 is a top view of a "slam" card.

Referring to FIGS. 1, 2, 3 and 6, a preferred embodiment includes a game board, a deck of cards, and a position marker. The game board has a total of 12 contiguous squares around its periphery. The four corner squares have the indicia "slam" printed. The squares in between have the indicia "take", "play", or "foul" as indicated in FIG. 1. As will be discussed below, each square requires a player to follow special steps.

The peripheral square indicating "slam" requires that a player take two cards one at a time. The player drawing the cards may keep the first card or pass it to another player. The player must keep or pass the second card drawn depending on whether the player passed or kept, respectively, the first card drawn.

A player landing on a peripheral square indicating "take" must draw a card from the deck and keep that card. A "foul" square requires a player to pass to an opponent the card drawn. The "play" square gives the player the choice of keeping the card or passing it. The player to whom a card was passed chooses on which stack the card will be placed.

Play begins by seating two or more players around the game board with a thoroughly shuffled deck of slam cards. A dealer is chosen and the board faces the dealer. The position marker in the shape of a bottle cap (FIG. 6) is placed on a "slam" square. Each player is dealt three cards face up, one at a time. The dealer draws the first card and moves the requisite number of spaces on the board in a counter clockwise fashion. Play advances in a counter clockwise manner based on seating around the board.

A player places a card on one of the three original cards to start building a stack. Players use strategy in building up the stacks to include the greatest number of cards. The numbers on the red, blue, and yellow cards are added until they equal nine. By playing a "slam" card, a player may either retire a stack when its total reaches nine, or the player can "let it ride" by placing "slam" cards on the stack to increase the score. However, the player who lets a stack ride risks being knocked out of play on a sacrifice or a Shut-out before retiring the stack. Players may only retire a stack immediately after placing a card on the stack so that it adds up to nine or immediately after placing a "slam" card on the stack.

The strategy includes passing specific cards to specific players, calculating the chances of retiring specific stacks as more cards are played, and choosing when to retire a stack.

Figure 4:
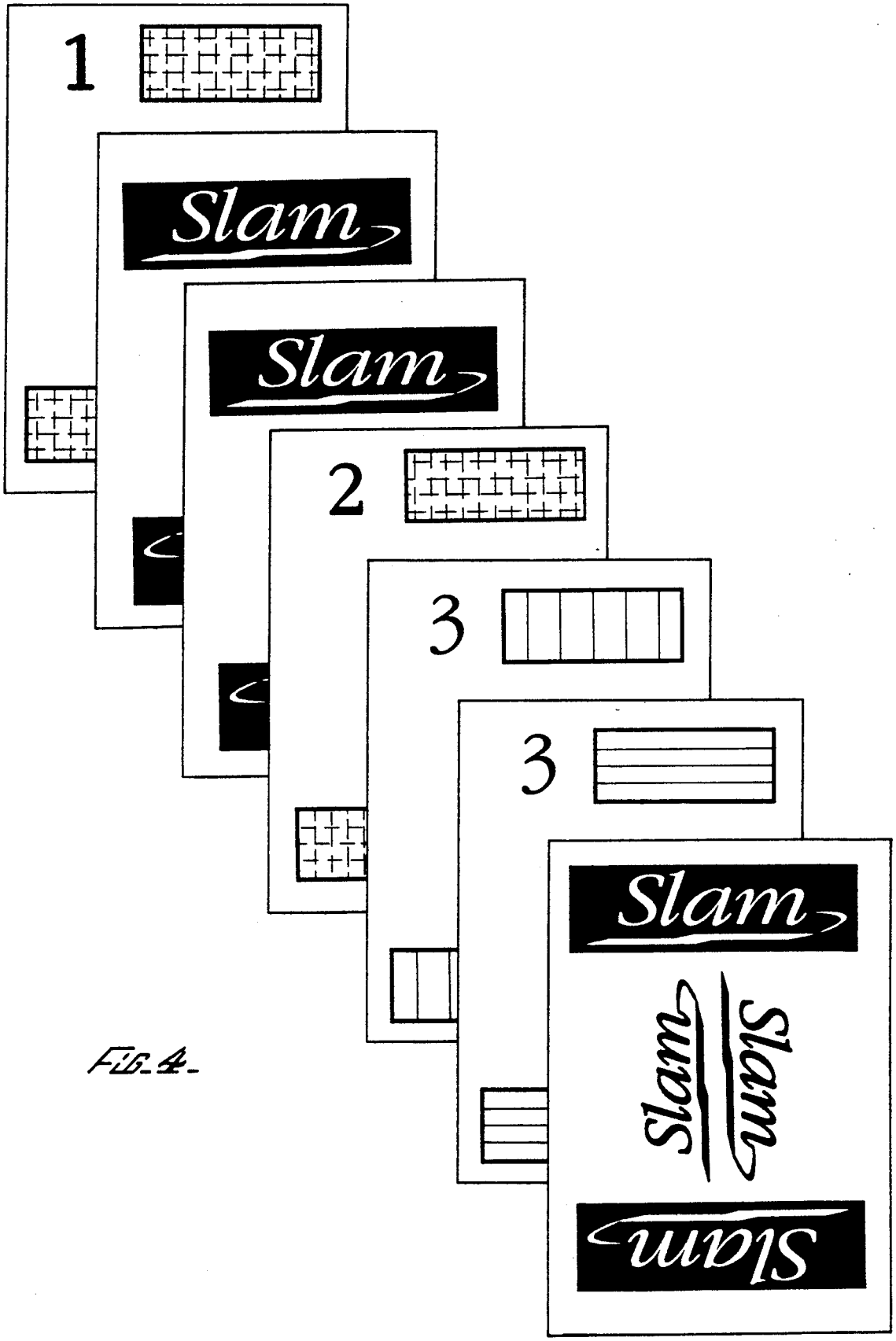
FIG. 4 represents a sample stack of cards and its score.
Figure 5:
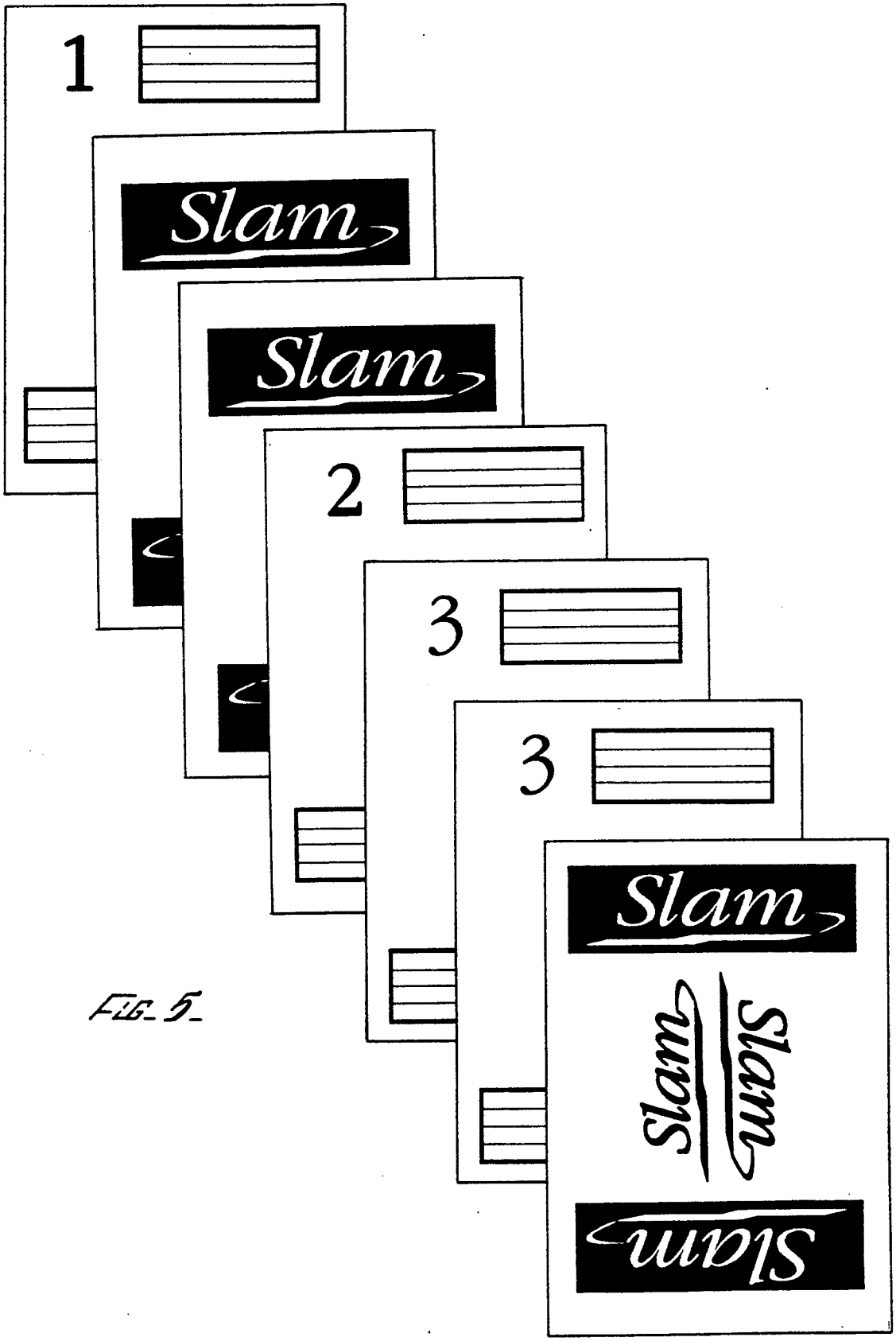
FIG. 5 represents a sample stack of cards in the same suit and its score.
Figure 1:
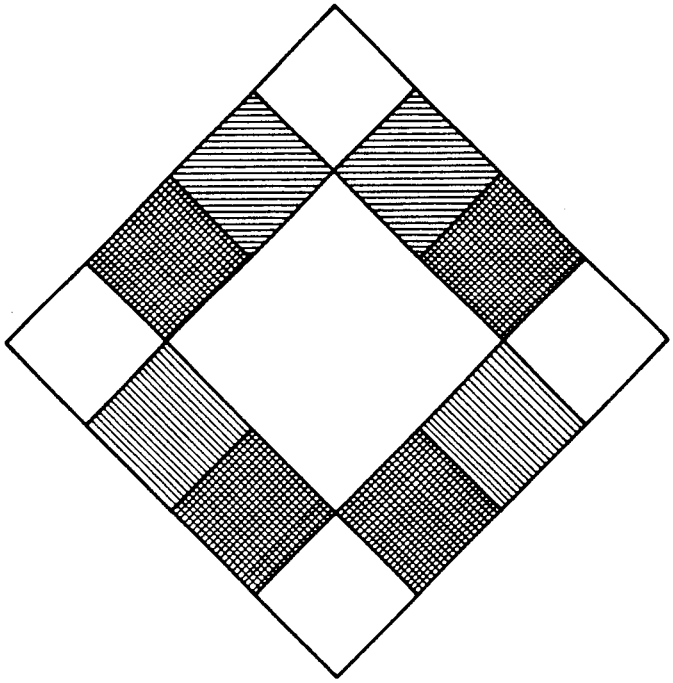
Figure 6:
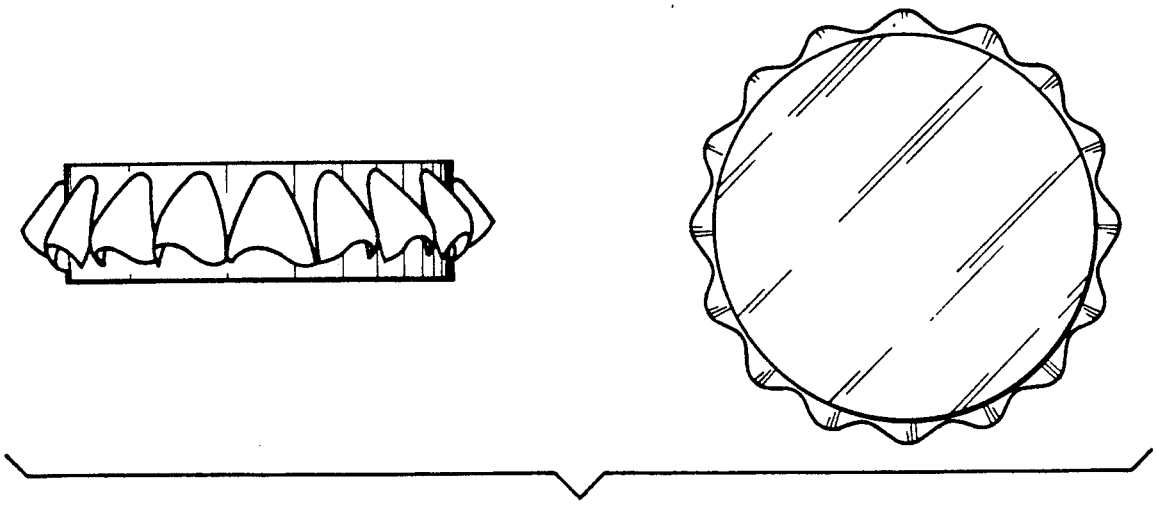
FIG. 6 is a pictorial view of a position marker.

Play for the round ends when the last remaining player finishes his/her game of solitaire. The round is scored before play is continued. FIG. 4 shows a stack containing 7 cards: 3 "slam" cards, and 4 cards with numbers adding up to 9. The point total is 7; one point is awarded for each card. FIG. 5 shows a similar stack except that the numbered cards are all of the blue suit. This stack has a total of 14 points. The normal 7 point score is doubled when all of the numbered cards are of the same suit. If one player retires all three stacks, this is called a Grand Slam and that player receives 4 bonus points. Other bonus points are available when a player gives a card to an opponent who is thereby prevented from retiring any stacks because the total of his/her stacks exceeds nine. This play is called a Shut-Out and the player passing the card gets four points. Note that if a player goes out with zero points by drawing a card him/herself, this is a sacrifice and not a Shut-Out.

After scoring the round, the dealer position moves in a counter clockwise fashion and a new round is begun. Four rounds make up one game. The player with the highest score wins.

Possible variations on the game include playing with sets of partners in a game with an even number of players. In such a variation, partners pass beneficial cards to one another and discuss strategy in passing cards to their opponents. As in the regular game, partners can score bonus points from Grand Slams and Shut-Outs. If two partners in a four player game each score Grand Slams, then the team receives four additional bonus points. If either one or both of two partners Shut-Out both opponent partners, then this is called a Double Shut-Out and it is worth four points. A Perfect Game is worth four points. It occurs when a Double Grand Slam and a Double Shut-Out are scored in the same game.

Another variation includes the use of chips. For example, one chip could be anted at the beginning of a round and whenever a slam card is drawn. Players could drop out any time during the game. Raises could be allowed when two players are left. One raise and a counter-raise could be possible after each slam card is played.

Another alternative is playing in solitaire fashion. The player does not use the board and deals three cards face up. The player turns over a card from the deck one at a time and places the card on a stack, using the same strategies involved at the end of a regular game.

The game is also easily adapted to play without the board. Play begins the same way except each player in turn, turns over one card which he/she can keep or pass.

I claim:

1. A method of playing a game, said game comprising:

a playing board including continuous sections around its periphery and those sections have indicia which may require a player to keep or pass cards that the player has drawn;

a board position marker; and a plurality of play cards including several suits, wherein each numbered suit includes two number 1 cards, three number 2 cards, five number 3 cards, three number 4 cards, and two number 5 cards, one suit of which is used to retire stacks of cards which have been stacked up according to options offered by the indicia of the game board, said method comprising:

forming said cards into stacks in which the total on the face cards adds up to a predetermined number;

scoring multiple points when the numbered cards in the stack are all of one suit; and scoring bonus points when another player is prevented from scoring or when a player retires all three of that player's stacks.

2. The game method of claim 1, wherein the indicia on the sections of the playing board may require a player either to draw and keep that card, to draw and pass that card, to draw and keep or pass that card on his discretion, or to draw two cards one at a time and to keep one and pass one.

3. The game method as claim 1, wherein the deck of play cards includes several suits which have the numbers 1–5 printed on them, and another suit that is used to retire stacks of cards which have been added up to a specific number.

4. A method of playing a game, said game comprising:

a deck of playing cards including one or more suits which have the numbers 1–5 printed on them, wherein each numbered suit includes two number 1 cards, three number 2 cards, five number 3 cards, three number 4 cards and two number 5 cards, and another suit that is used to retire stacks of cards which have been added up to a specific number, said method comprising:

forming said cards into stacks in which the total on the face cards adds up to said specific number;

scoring multiple points when the deck has more than one numbered suit and cards in the stack are all of one suit; and scoring bonus points when another player is preventing from scoring or when a player retires all three of that player's stacks.

5. The game method of claim 1, 4 or 2, wherein players can discuss with each other the strategy of whether to keep or pass cards and the strategy of to whom the cards will be passed.

6. The game method of claim 4 or 3, wherein there are three suits of 15 cards each which are numbered 1–5.

* * * * *